US008221953B2

(12) United States Patent
Morales-Tirado et al.

(10) Patent No.: US 8,221,953 B2
(45) Date of Patent: Jul. 17, 2012

(54) EMULSION AGGREGATION PROCESS

(75) Inventors: Juan A. Morales-Tirado, West Henrietta, NY (US); Chieh-Min Cheng, Rochester, NY (US); Daniel W. Asarese, Honeoye Falls, NY (US); Yolanda E. Maldonado, Webster, NY (US); Samir Kumar, Pittsford, NY (US); Elias Panides, Whitestone, NY (US); Christopher M. Wolfe, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 27 days.

(21) Appl. No.: 12/784,776

(22) Filed: May 21, 2010

(65) Prior Publication Data

US 2011/0287359 A1 Nov. 24, 2011

(51) Int. Cl.
*G03G 9/08* (2006.01)

(52) U.S. Cl. ..... 430/137.11; 430/137.14

(58) Field of Classification Search ..... 430/137.11, 430/137.14

See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,983,045 | A | 9/1976 | Jugle et al. |
| 4,265,990 | A | 5/1981 | Stolka et al. |
| 4,298,672 | A | 11/1981 | Lu |
| 4,338,390 | A | 7/1982 | Lu |
| 4,563,408 | A | 1/1986 | Lin et al. |
| 4,584,253 | A | 4/1986 | Lin et al. |
| 4,935,326 | A | 6/1990 | Creatura et al. |
| 4,937,166 | A | 6/1990 | Creatura et al. |
| 5,227,460 | A | 7/1993 | Mahabadi et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |

(Continued)

FOREIGN PATENT DOCUMENTS

JP 2001255697 A * 9/2001

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

*Primary Examiner* — Christopher Rodee
(74) *Attorney, Agent, or Firm* — MDIP LLC

(57) ABSTRACT

The present disclosure provides emulsion aggregation (EA) toner particles having less pigment on the particle surface and a more uniform pigment distribution. The process of preparing the toner includes specific mixing speeds and use of specific temperatures during the emulsion aggregation process and the addition of a shell to the toner particles.

9 Claims, 3 Drawing Sheets

U.S. PATENT DOCUMENTS

| | | | | |
|---|---|---|---|---|
| 5,403,693 | A | 4/1995 | Patel et al. | |
| 5,405,728 | A | 4/1995 | Hopper et al. | |
| 5,418,108 | A | 5/1995 | Kmiecik-Lawrynowicz et al. | |
| 5,496,676 | A | 3/1996 | Croucher et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,723,253 | A | 3/1998 | Higashino et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,977,210 | A | 11/1999 | Patel et al. | |
| 6,004,714 | A | 12/1999 | Ciccarelli et al. | |
| 6,190,815 | B1 | 2/2001 | Ciccarelli et al. | |
| 6,268,102 | B1 * | 7/2001 | Hopper et al. | 430/137.14 |
| 6,730,450 | B1 | 5/2004 | Moffat et al. | |
| 6,743,559 | B2 | 6/2004 | Combes et al. | |
| 6,756,176 | B2 | 6/2004 | Stegamat et al. | |
| 6,780,500 | B2 | 8/2004 | Dumouchel | |
| 6,830,860 | B2 | 12/2004 | Sacripante et al. | |
| 7,029,817 | B2 | 4/2006 | Robinson et al. | |
| 2006/0286478 | A1 | 12/2006 | Chung et al. | |
| 2007/0212633 | A1 * | 9/2007 | Yamagami | 430/137.14 |
| 2008/0248415 | A1 * | 10/2008 | Maezawa et al. | 430/112 |

* cited by examiner

ONE-WAY ANOVA: % PARTICLES VERSUS PROCESS

| SOURCE | DF | SS | MS | F | P |
|---|---|---|---|---|---|
| PROCESS | 1 | 2909 | 2909 | 15.51 | 0.002 |
| ERROR | 11 | 2064 | 188 | | |
| TOTAL | 12 | 4973 | | | |

S = 13.70 R-Sq = 58.51% R-Sq (adj) = 54.73%

| LEVEL | N | MEAN | StDev | INDIVIDUAL 95% CIs FOR MEAN BASED ON POOLED StDev |
|---|---|---|---|---|
| NEW | 5 | 16.00 | 11.98 | (--------*--------) |
| OLD | 8 | 46.75 | 14.59 | (--------*--------) |

--------+---------+---------+---------+-
15 30 45 60

EMULSION AGGREGATION PROCESS

TECHNICAL FIELD

This disclosure is generally directed to toner processes, and more specifically, emulsion aggregation and coalescence processes, as well as toner compositions formed by such processes.

BACKGROUND

Emulsion aggregation/coalescing processes for the preparation of toners are illustrated in a number of patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817. The disclosures of each of the foregoing patents and publications are hereby incorporated by reference in their entirety.

In a number of electrophotographic engines and processes, toner images may be applied to substrates. Image quality issues may arise from many different factors, for example, free pigment on the surface of toner particles. In a two component system, free pigment and its distribution within and between toner particles may lead to poor, non-uniform charging behavior of the particles.

Improved toners that have toner particles with less pigment on the surface and more uniform pigment distribution remain desirable.

SUMMARY

The present disclosure provides processes for producing toners. In embodiments, a process of the present disclosure includes aggregating a mixture including a latex resin and at least one colorant in a reactor possessing an impeller operating at a tip speed of from about 3.1 meters/second to about 5 meters/second to form aggregated toner particles; adding a shell resin to form a shell over the aggregated toner particles; coalescing the aggregated toner particles; and recovering the toner particles.

In other embodiments, a process of the present disclosure may include aggregating a mixture including a latex resin in a reactor possessing an impeller operating at a tip speed of from about 4.5 meters/second to about 4.9 meters/second, for a period of time of from about 4 hours to about 6 hours, to form aggregated toner particles; reducing the impeller tip speed to from about 2.5 meters/second to about 3.5 meters/second; adding a shell resin to form a shell over the aggregated toner particles; coalescing the aggregated toner particles; and recovering the toner particles.

Toners produced by these processes are also provided.

BRIEF DESCRIPTION OF THE DRAWINGS

Various embodiments of the present disclosure will be described herein below with reference to the following figures wherein.

DETAILED DESCRIPTION

Figures 1A, 1B:
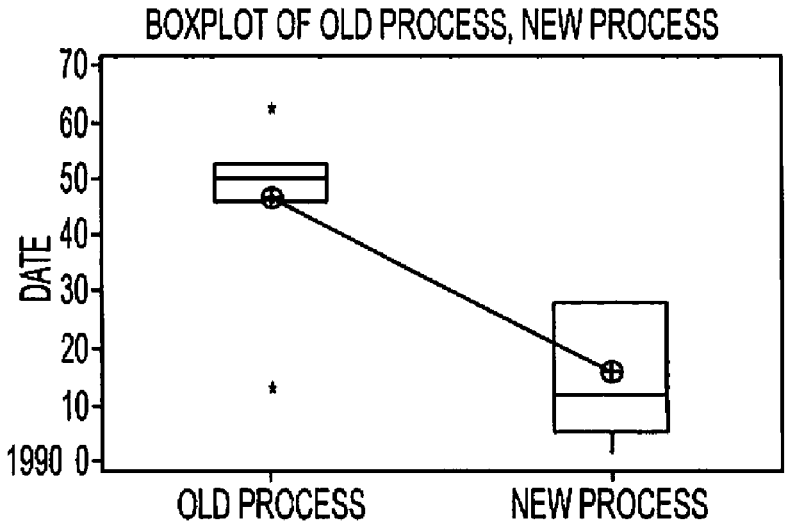
FIG. 1A is a graph showing charge spectra of toner particles produced in accordance with the present disclosure compared with a conventional process.
FIG. 1B are the results of a one-way ANOVA for the data set forth in FIG. 1A.

In accordance with the present disclosure, emulsion aggregation (EA) toner particles having less pigment on the particle surface and a more uniform pigment distribution are disclosed. The process of preparing the toner includes specific mixing speeds and use of specific temperatures during the emulsion aggregation process and the addition of a shell to the toner particles.

The process of the present disclosure affords better packing of the pre-shell aggregated toner particles and minimizes erosion of the shell latex during addition to aggregated toner particles. The specific temperature used may also stabilize the toner particles by increasing the freeze temperature, i.e., the temperature at which the growth of the toner particles ceases. The resulting minimized erosion of the shell may allow for better incorporation of the shell latex and a more uniform shell composition on the surface of the toner particles.

Latex Resin

Any monomer suitable for preparing a latex for use in a toner may be utilized. As noted above, in embodiments the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex resin may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), polyacrylonitrile-butyl acrylate-acrylic acid), and combinations thereof. The polymers may be block, random, or alternating copolymers.

In addition, polyester resins which may be used include those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol.

In embodiments, a poly(styrene-butyl acrylate) may be utilized as the latex resin. The glass transition temperature of this latex, which in embodiments may be used to form a toner of the present disclosure, may be from about 35° C. to about 75° C., in embodiments from about 40° C. to about 70° C.

Surfactants

In embodiments, the latex may be prepared in an aqueous phase containing a surfactant or co-surfactant. Surfactants which may be utilized with the polymer to form a latex dispersion can be ionic or nonionic surfactants in an amount to provide a dispersion of from about 0.01 to about 15 weight percent solids, in embodiments of from about 0.1 to about 5 weight percent solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., DOWFAX™ obtained from Dow Chemical, combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis{2-[1-(2-hydroxyethyl)-2-imidazolin-2-yl]propane}dihydrochloride, combinations thereof, and the like.

Initiators can be added in suitable amounts, such as from about 0.1 to about 8 weight percent of the monomers, and in embodiments of from about 0.2 to about 5 weight percent of the monomers.

Chain Transfer Agents

In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the latex polymer.

Gel Latex

In embodiments, a gel latex may be added to the non-crosslinked latex resin suspended in the surfactant. As used herein a gel latex may refer to, in embodiments, a crosslinked resin or polymer, or mixtures thereof, or a non-crosslinked resin as described above, that has been subjected to crosslinking.

The gel latex may include submicron crosslinked resin particles having a size of from about 10 to about 300 nanometers in volume average diameter, in embodiments from about 20 to 100 nanometers in volume average diameter. The gel latex may be suspended in an aqueous phase of water containing a surfactant, wherein the surfactant can be in an amount from about 0.3 about 10 percent by weight of total solids, or from about 0.7 to about 5 percent by weight of total solids.

The crosslinked resin may be a crosslinked polymer such as crosslinked styrene acrylates, styrene butadienes, and/or styrene methacrylates. In particular, exemplary crosslinked resins are crosslinked poly(styrene-alkyl acrylate), poly(styrene-butadiene), poly(styrene-isoprene), poly(styrene-alkyl methacrylate), poly(styrene-alkyl acrylate-acrylic acid), poly (styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly (alkyl acrylate-acrylonitrile-acrylic acid), and mixtures thereof.

A crosslinker, such as divinyl benzene or other divinyl aromatic or divinyl acrylate or methacrylate monomers may be used in the crosslinked resin. The crosslinker may be present in an amount of from about 0.01 to about 25 percent by weight of the crosslinked resin, or from about 0.5 to about 20 percent by weight of the crosslinked resin.

The crosslinked resin particles may be present in an amount of from about 1 to about 20 percent by weight of the toner, in embodiments from about 4 to about 15 percent by weight of the toner, in embodiments from about 5 to about 14 percent by weight of the toner.

In embodiments, the resin utilized to form the toner may be a mixture of a gel resin and a non-crosslinked resin.

Functional Monomers

In embodiments, it may be advantageous to include a functional monomer when forming a latex polymer and the particles making up the polymer. Suitable functional monomers include monomers having carboxylic acid functionality. Such functional monomers may be of the following formula (I):

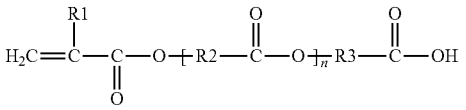

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such functional monomers include beta carboxyethyl acrylate (β-CEA), poly(2-carboxyethyl) acrylate, 2-carboxyethyl methacrylate, combinations thereof, and the like. Other functional monomers which may be utilized include, for example, acrylic acid and its derivatives.

In embodiments, the functional monomer having carboxylic acid functionality may also contain a small amount of metallic ions, such as sodium, potassium and/or calcium, to achieve better emulsion polymerization results. The metallic ions may be present in an amount from about 0.005 to about 8 percent by weight of the functional monomer having carboxylic acid functionality, in embodiments from about 0.5 to about 5 percent by weight of the functional monomer having carboxylic acid functionality.

Where present, the functional monomer may be added in amounts from about 0.01 to about 5 percent by weight of the toner, in embodiments from about 0.05 to about 2 percent by weight of the toner.

Additional functional monomers that may be utilized in the toner formulation processes include bases such as metal hydroxides, including sodium hydroxide, potassium hydroxide, ammonium hydroxide, and optionally combinations thereof. Also useful as a functional monomer are carbonates including sodium carbonate, sodium bicarbonate, calcium carbonate, potassium carbonate, ammonium carbonate, combinations thereof, and the like. In other embodiments, a functional monomer may include a composition containing sodium silicate dissolved in sodium hydroxide.

In the emulsion polymerization process, the reactants may be added to a suitable reactor, such as a mixing vessel. The appropriate amount of at least one monomer, in embodiments from about two to about ten monomers, surfactant(s), functional monomer, if any, initiator, if any, chain transfer agent, if any, colorant, if any, and the like, may be combined in the reactor and the emulsion polymerization process may be allowed to begin.

Polymerization may occur until nanometer size particles may be formed, from about 50 nm to about 800 nm in volume average diameter, in embodiments from about 100 nm to about 400 nm in volume average diameter, as determined, for example, by a Brookhaven nanosize particle analyzer.

Wax

Wax dispersions may also be added during formation of a toner particle in an emulsion aggregation process. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 1 to about 5 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Colorants

A colorant dispersion may be added to the latex particles and optional wax. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. In embodiments, the surfactant may be ionic and may be from about 1 to about 25 percent by weight, and in embodiments from about 4 to about 15 percent by weight, of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or combinations thereof. In embodiments a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including RHODAMINE B™ type, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company.

Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra (octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

In embodiments, colorant examples include Pigment Blue 15:3 (sometimes referred to herein, in embodiments, as PB 15:3 cyan pigment) having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant. Pigment Red 122 (sometimes referred to herein as PR-122) has been widely used in the pigmentation of toners, plastics, ink, and coatings, due to its unique magenta shade.

Aggregating Agents

In embodiments, an aggregating agent may be added during or prior to aggregating the latex and any colorant, in embodiments a colorant in an aqueous colorant dispersion.

Examples of suitable aggregating agents include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. In embodiments, suitable aggregating agents include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid.

In embodiments, a suitable aggregating agent includes PAC, which is commercially available and can be prepared by the controlled hydrolysis of aluminum chloride with sodium hydroxide.

Suitable amounts of aggregating agent may be from about 0.02 parts per hundred (pph) to about 2 pph, in embodiments from about 0.1 pph to about 1.5 pph.

Aggregation Reaction Conditions

Several factors may affect aggregation and coalescence of the toner particles. These include, for example, the chemical and physical properties of components making up the toner; any flocculant; temperature; thermal energy input to the particles in suspension; shear; shear distribution within the reactor; pH adjustments during processing; combinations thereof, and the like. In accordance with the present disclosure, when factors other than temperature and shear are constant, the rate of toner particle growth may depend on the balance of the temperature and shear. For example, at a constant shear, the rate of toner particle growth may be directly proportional to the temperature and flow rate of any heat transfer fluid in a reactor jacket, the amount of heat transfer area per unit of volume, and the amount of fluid inside the reactor.

At any given temperature, the amount of shear should be sufficient to maintain circulation of the solids in suspension and promote contact between the solids in order to enable flocculation. However, the shear should not be so high as to stall toner particle growth or cause erosion of components incorporated in the outer layer of the particles.

Aggregation of particles may be conducted in a jacketed reactor with an anchor blade impeller, or any other impeller capable of intimately mixing viscous materials to create near homogenous mixtures. Identifying adequate shear profile requires consideration of slurry viscosity and toner particle size. In accordance with the present disclosure, shear profile may be adjusted by altering the tangential speed of the impeller, sometimes referred to herein, in embodiments, as "tip speed." The tip speed may be determined by the following equation:

$$\text{Tip Speed} = \text{speed of rotation of the impeller(rpm)} \times \Pi \times \text{diameter of impeller}$$

where rpm is revolutions per minute.

In embodiments, the tip speed may be from about 3.1 meters/second to about 5 meters/second, in embodiments, the tip speed is from about 4.5 meters/second to about 4.9 meters/second during aggregation, prior to addition of any shell. These amounts are based on production scale impeller size.

Mixing of the individual components prior to starting the aggregation of the particles may occur over a period of from about 60 minutes to about 120 minutes, in embodiments from about 65 minutes to about 90 minutes. The resulting blend of latex, optionally in a dispersion, optional colorant dispersion, wax, and aggregating agent, may then be stirred and heated to a temperature of from about 50° C. to about 53° C., in embodiments from about 50.5° C. to about 52.5° C.

The particles may be permitted to aggregate until a predetermined desired particle size is obtained. Samples may be taken during the growth process and analyzed, for example with a Coulter Counter, for volume average particle size. The aggregation thus may proceed by slowly raising the temperature, for example, from about 28° C. to about 53° C. in about 4 hours to about 6 hours, and holding the mixture at this temperature for a time from about 0.25 hours to about 1 hour, in embodiments from about hour 0.5 to about 0.75 hours, while maintaining stirring, to provide the aggregated particles. Once the predetermined desired particle size is reached, then the growth process is halted.

The growth and shape of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions, i.e., an impeller tip speed of from about 4.5 meters/seconds to about 4.9 meters/seconds at an elevated temperature, for example of from about 50° C. to about 53° C., in embodiments from about 50.5° C. to about 52.5° C.

The resulting toner aggregates have a particle size of from about 3 microns to about 15 microns in volume average diameter, in embodiments of from about 5 microns to about 9 microns in volume average diameter.

Once the desired size of the toner particles is achieved, the pH of the mixture may be adjusted with a base to a value of from about 2.5 to about 7, in embodiments from about 3 to about 5.8. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 5 percent by weight of the mixture.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Shell

In embodiments, while not required, a shell may be formed on the aggregated particles. Any latex utilized noted above to form the core latex may be utilized to form the shell latex. In embodiments, a styrene-n-butyl acrylate copolymer may be utilized to form the shell latex.

In embodiments, the shell resin may be in an emulsion including any surfactant described above. The impeller tip speed may be adjusted down to a speed of about 2.5 meters/second to about 3.5 meters/second, in embodiments from about 3 meters/second to about 3.2 meters/second. The shell resin may then be added to the aggregated particles. This speed is based on production scale impeller size.

The shell latex may be applied until the desired final size of the toner particles is achieved, in embodiments from about 3 microns to about 15 microns, in other embodiments from about 4 microns to about 9 microns. In other embodiments, the toner particles may be prepared by in-situ seeded semi-continuous emulsion copolymerization of the latex with the addition of the shell latex once aggregated particles have formed.

Where present, the shell latex may be present in an amount of from about 20 to about 40 percent by weight of the dry toner particle, in embodiments from about 26 to about 36 percent by weight of the dry toner particle, in embodiments about 27 to about 34 percent by weight of the dry toner particle.

Coalescing may include stirring and heating at a temperature of from about 80° C. to about 99° C., in embodiments from about 93° C. to about 98° C., resulting in a toner shape, sometimes referred to herein, in embodiments, as circularity, of from about 0.900 to about 0.999, in embodiments of from about 0.950 to about 0.998, in embodiments of from about 0.970 to about 0.985.

Coalescing may be accelerated by adjusting the pH of the mixture to less than 6 with, for example, an acid to coalesce the toner aggregates. Once the desired shape of the toner particles is achieved, the pH of the mixture may be adjusted with a base to a value of less than 9.

The toner slurry may then be washed to remove surfactants. Particles are then dried so that they have a moisture level below 1%.

Particles of the present disclosure may have a desirable surface area for use as toner. Surface area may be determined in embodiments, by the Brunauer, Emmett and Teller (BET) method. BET surface area of a sphere can be calculated by the following equation:

$$\text{Surface Area}(m^2/g)=6/(\text{Particle Diameter}(um)*\text{Density}(g/cc)).$$

Toner particles may have a surface area of from about 0.5 $m^2/g$ to about 1.6 $m^2/g$, in embodiments from about 0.6 $m^2/g$ to about 1.2 $m^2/g$, in some embodiments from about 0.7 $m^2/g$ to about 1.0 $m^2/g$.

In embodiments, toners of the present disclosure may have a triboelectric charge of from about −10 μC/g to about −70 μC/g, in embodiments from about −30 μC/g to about −60 μC/g.

The amount of residual pigment on the surface of the particle may be determined as follows. The technique is based on light absorbance of a solids dispersion. A particle sample is dispersed in water with the help of a surfactant to help the dispersion process. The particle dispersion is then sonified to remove the exposed pigment from the surface of the particle. The heavier solids (in this case the particle) settle at the bottom of the sample container, while the more lighter pigment particles remain in suspension. In embodiments, the procedure for obtaining the light absorbance may be as follows:

(1) About one part by weight of a toner is placed in a sample bottle with about 90 parts by weight of ion-exchange water and about 0.5 part by weight of a surface active agent (e.g., Triton X100);

(2) The toner is stirred on a vortex mixer for about ten seconds and then ultrasonically cleaned for about ninety minutes;

(3) The toner is separated by a centrifugal separator operating at about 4600 rpm for about ten minutes;
(4) The supernatant in the bottle is collected by a pipette; and
(5) The supernatant is analyzed by a spectrophotometer (of Hitachi, Limited) for its absorption of ultraviolet radiation having a wavelength of about 600 nm.

The lower the absorbance, the lower the level of pigment particles in suspension, indicating a lower level of pigment on the surface of the particle. Utilizing the methods of the present disclosure, the percent light absorbance of a toner particle of the present disclosure may be from about 0.01% to about 0.021%, in embodiments from about 0.012% to about 0.019%.

Additives

Further optional additives which may be combined with a toner include any additive to enhance the properties of toner compositions. For example, the toner may include positive or negative charge control agents, for example in an amount of from about 0.1 to about 10 percent by weight of the toner, in embodiments from about 0.7 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like.

Other additives which may be combined with a toner composition of the present disclosure include surface additives, color enhancers, etc. Surface additives that can be added to the toner compositions after washing and drying include, for example, metal salts, metal salts of fatty acids, colloidal silicas, metal oxides, strontium titanates, combinations thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner particles produced utilizing a latex of the present disclosure may have a size of about 1 micron to about 20 microns, in embodiments about 3 microns to about 15 microns, in embodiments from about 6.5 microns to about 8 microns. Toner particles of the present disclosure may have a circularity of from about 0.900 to about 0.999, in embodiments from about 0.950 to about 0.998, in some embodiments from about 0.970 to about 0.985.

Uses

Toners in accordance with the present disclosure can be used in a variety of imaging devices including printers, copy machines, and the like. The toners generated in accordance with the present disclosure are excellent for imaging processes, especially xerographic processes, and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, combinations thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

Five batches of toner particles were prepared according to the present disclosure as follows. A pre-mix tank was charged with about 9143 kilograms (kg) of de-ionized water, about 4254 kg of a styrene-butylacrylate resin in a latex emulsion having a solids content of about 41.5%, and about 1188 kg of a carbon black pigment dispersion having a solids content of about 17%. In a separate mixing tank, an aggregating agent solution was prepared by combining and mixing together about 467 kg of de-ionized water, about 34.1 kg of a 0.3M nitric acid solution, and about 56.5 kg of a 10% solution of a suitable aggregating agent such as polyaluminum chloride. The pre-mix tank was then charged with about 1142 kg of a polyethylene wax dispersion having a solids content of about 31%, followed by the aggregating agent solution. The aggregating agent solution was transferred into the pre-mix tank at a rate of about 17 kg/minute.

The ingredients in the pre-mix tank were then mixed together for a period of time of from about 60 minutes to about 90 minutes. The contents of the pre-mix tank were then transferred to a jacketed reactor.

After completion of the transfer process the batch temperature was raised from about 28° C. to about 52° C. During this time the tip speed of the impeller was maintained from about 4.5 meters/second to about 4.9 meters/second. The batch was then maintained at a temperature of from about 50.5° C. to about 53° C. until the particles aggregated and reached the target size.

Once the particles reached the target size, the impeller speed was reduced to from about 3 meters/second to about 3.2 meters/second. Following the adjustment of the impeller speed, a shell latex was added into the jacketed reactor and mixed with the formed particles until the final size of the toner particles was achieved.

Once the final size was achieved, the growth of the particle was stopped by the addition of a suitable base such as sodium hydroxide until the slurry pH reached a value of from about 5.2 to about 5.8. Once the pH was confirmed, the batch temperature was raised to a target of from about 93° C. to about 98° C. Once the batch reached a temperature of about 65° C., the contents of the reactor were transferred to a second jacketed reactor. Once the transfer was completed, the pH of the slurry was measured and adjusted to a value of from about 4.4 to about 4.9 if necessary. Once the slurry reached a temperature of from about 93° C. to about 98° C., it was maintained under those conditions for from about 3 to about 4 hours to achieve the desired circularity.

The amount of carbon black on the surface of the particles was assessed using an Epping charge spectra test. Toner particles were separated based on their charge and both high and low charge tails of the sample were analyzed via scanning electron microscope (SEM), thereby assessing the surface carbon black content. High surface carbon black concentration, especially in the low charge region, may lead to non-uniform charging of the toner, spots, and background.

The five batches of toner particles prepared according to the present disclosure were compared with eight batches of toner particles prepared by conventional emulsion aggregation processes. A graph is provided in FIG. 1A showing the percentage of particles having a high level of surface pigment in toners prepared using the old process and toners prepared using the new process. The process of the present disclosure resulted in a reduction in the concentration of particles with high surface pigment in the low charge region as compared to the conventional (old) process. FIG. 1B shows a one-way analysis of variance (ANOVA) of the particles. The ANOVA shows that the differences in the process of the disclosure compared with the conventional process account for about 58% of the differences observed in the charging of the toner particles.

Example 2

Degradation of charging characteristics of toner particles over time were measured by a stress admix test. Slow admix may be indicative of degradation of charging performance. A slow admix may exhibit a bimodal charge distribution curve which slowly forms a unimodal curve. The amount of carbon black present on the surface of the particles may affect the rate of admix, with a higher amount causing slower admix.

Figure 2:
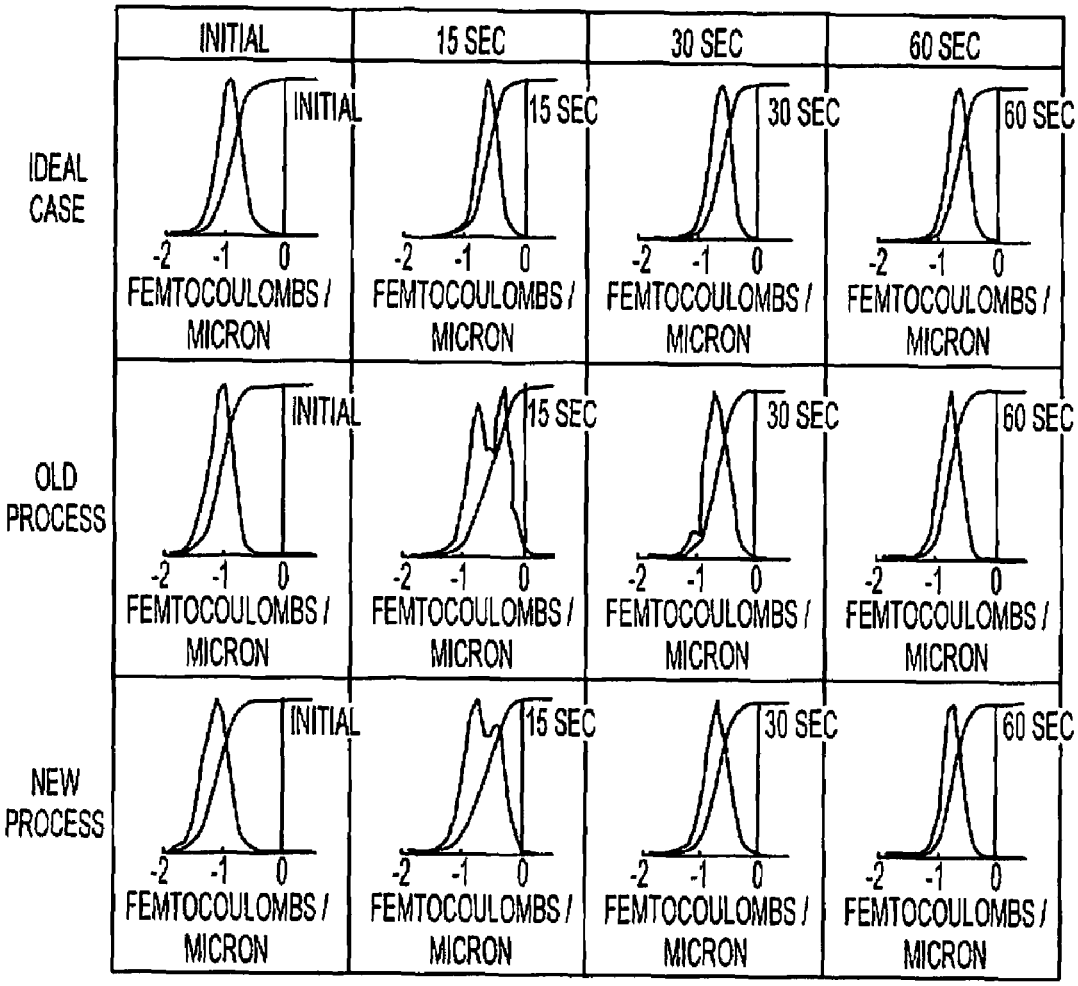
FIG. 2 is a graph comparing toner aging characteristics based on the mixing process used.

Ideal toner particles would be unimodal from the time of admix with a developer. A chart showing charge curve at several time points for an ideal toner, a toner prepared by a conventional process, and a toner prepared using the process of the disclosure, is shown in FIG. 2. The particles made using the process of the present disclosure exhibited a charge distribution closer to that of the ideal toner.

Example 3

Figure 3:
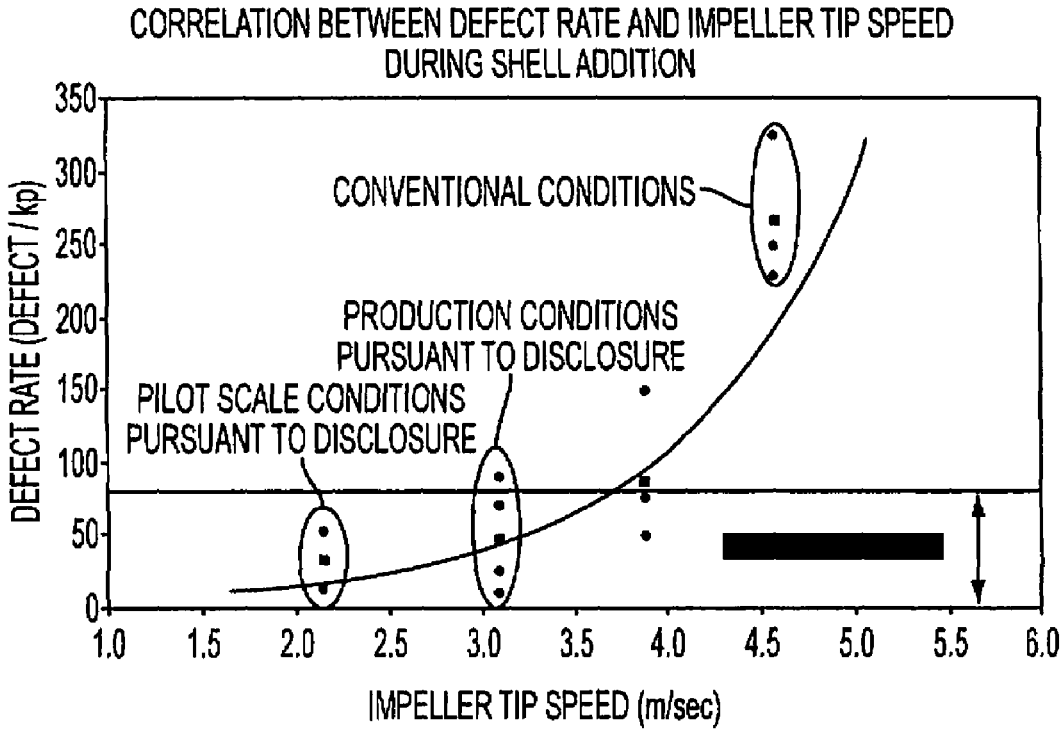
FIG. 3 is a graph demonstrating toner particle defect rate verses impeller tip speed during shell addition for particles produced in accordance with the present disclosure.

Defect rate, a measure of image quality, was evaluated based on the presence of spots, spot groups, or smudges on a printed media. A comparison of defect rate of toners prepared using various impeller tip speeds during shell addition is shown in FIG. 3. The process of the present disclosure exhibited a defect rate much lower than that of toners prepared using a conventional process.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method comprising;

aggregating a mixture comprising a latex resin in a reactor possessing an impeller operating at a tip speed of from about 4.5 meters/second to about 4.9 meters/second for a period of time of from about 4 hours to about 6 hours, to form aggregated toner particles;

reducing the impeller tip speed to from about 2.5 meters/second to about 3.5 meters/second;

adding a shell resin to form a shell over the aggregated toner particles;

coalescing the aggregated toner particles; and recovering the toner particles.

2. The method of claim 1, wherein aggregating the mixture occurs at a temperature of from about 50.5° C. to about 52.5° C. to form aggregated toner particles.

3. The method of claim 1, wherein the tip speed is calculated as follows:

Tip Speed=speed of rotation of the impeller(revolutions per minute)×Π×diameter of impeller.

4. The method of claim 1, further comprising adjusting the pH of the aggregated toner particles to from about 2.5 to about 7.

5. The method of claim 1, wherein the latex resin is selected from the group consisting of styrenes, acrylates, methacrylates, butadienes, isoprenes, acrylic acids, methacrylic acids, acrylonitriles, and combinations thereof.

6. The method of claim 1, wherein the latex resin comprises styrene, butyl acrylate, and beta carboxyethyl acrylate.

7. The method of claim 1, wherein the mixture further comprises a component selected from the group consisting of aggregating agents, surfactants, functional monomers, initiators, surface additives, charge control agents, chain transfer agents, and combinations thereof.

8. The method of claim 1, wherein the mixture further comprises an aggregating agent selected from the group consisting of polyaluminum chloride, polyaluminum sulfo silicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, and combinations thereof.

9. The method of claim 1, wherein the toner particles have a light absorbance of from about 0.01%.

* * * * *